United States Patent [19]

Mal et al.

[11] 3,977,837

[45] Aug. 31, 1976

[54] TITANIUM CARBIDE TOOL STEEL HAVING IMPROVED PROPERTIES

[75] Inventors: M. Kumar Mal, Spring Valley; Stuart E. Tarkan, Monsey, both of N.Y.

[73] Assignee: Chromalloy American Corporation, New York, N.Y.

[22] Filed: Nov. 6, 1973

[21] Appl. No.: 413,332

[52] U.S. Cl. ..... 29/182.7; 29/182.8; 75/123 E; 75/126 G; 75/128 E; 75/203; 75/204

[51] Int. Cl.[2] ..... C22C 29/00; C22C 1/04; C22C 1/05; C22C 33/02

[58] Field of Search ..... 75/203, 204, 128 E, 75/126 G, 123 E; 29/182.7, 182.8

[56] References Cited

UNITED STATES PATENTS

| | | | |
|---|---|---|---|
| 2,553,330 | 5/1951 | Post et al. | 75/128 E |
| 2,823,992 | 2/1958 | Bolkcom et al. | 75/128 E |
| 2,823,995 | 2/1958 | Bolkcom et al. | 75/128 E |
| 2,828,202 | 3/1958 | Goetzel et al. | 75/123 |
| 2,861,908 | 11/1958 | Mickelson et al. | 75/128 E |
| 2,876,095 | 3/1959 | Dickerson | 75/128 E |
| 3,416,976 | 12/1968 | Brill-Edwards | 148/12.4 |
| 3,653,982 | 4/1972 | Prill | 29/182.5 |
| 3,720,504 | 3/1973 | Frehn | 29/182.7 |

*Primary Examiner*—Brooks H. Hunt

*Attorney, Agent, or Firm*—Hopgood, Calimafde, Kalil, Blaustein and Lieberman

[57] ABSTRACT

A sintered steel-bonded titanium carbide composition characterized by an improved combination of physical and anti-friction properties is provided comprising about 15 to 60% by weight of primary grains of titanium carbide dispersed through a steel matrix making up essentially the balance, the steel matrix being characterized metallographically by an austenitic decomposition product and containing a small but effective amount of misch metal ranging from about 0.1 to 1.25% by weight of said matrix sufficient to effect a substantial improvement in said properties.

40 Claims, 2 Drawing Figures

TITANIUM CARBIDE TOOL STEEL HAVING IMPROVED PROPERTIES

Figure 1:
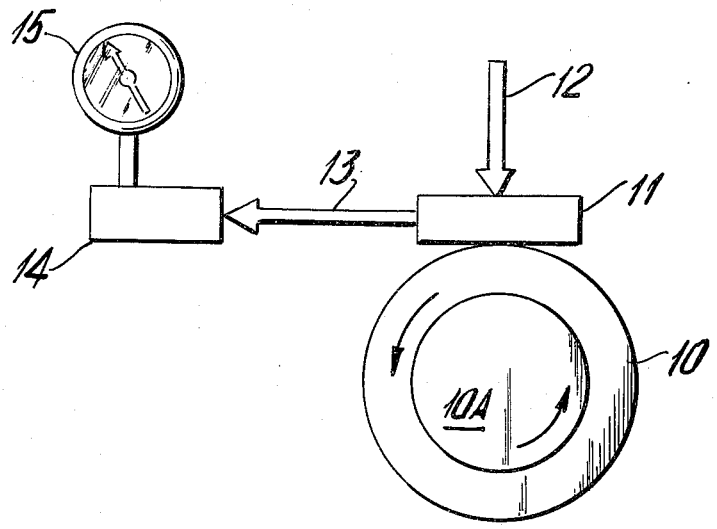

This invention relates to a sintered steel-bonded titanium carbide composition and a method of producing the same, and to a hardened wear resistant element produced from said composition characterized by an improved combination of properties, including improved transverse rupture strength, improved resistance to thermal shock, improved resistance to impact, improved anti-friction properties, and the like.

STATE OF THE ART

The development of the rotary combustion engine has aroused a great deal of interest in automotive circles and indications are that the large automotive companies have committed themselves to putting cars on the road in the near future powered by such engines.

However, industry is faced with many problems concerning the successful use of such engines. For example, extensive tests to date have pointed up the necessity of providing improved sophisticated seal materials to meet the stringent demands of the rotary engine. A very important and critical component of the engine is the "apex seal" which serves the purpose on the rotary piston of sealing off the various compartments of the trochoidal chamber within the housing. These seals, which are subjected to heat, oxidation, and to wear by abrasion, must be capable of exhibiting durability and reliability for at least 100,000 miles of operation and should exhibit the required combination of physical and chemical properties, such as resistance to oxidation and corrosion at elevated temperatures, high transverse rupture strength, good resistance to impact, and good anit-friction properties (that is to say, low sliding friction) so as to provide the desired resistance to wear, and the like. Moreover, the seal material must exhibit adequate compatability against the trochoidal surface of the engine chamber which is usually coated with a wear resistant material, such as chromium and Elnisil (trademark). The latter material is a coating composition comprising 5% weight of finely divided silicon carbide uniformly dispersed through a matrix of an electroplate of nickel.

A sintered steel-bonded titanium carbide tool steel composition which has been proposed for apex seals is one comprising about 45$^{v}$/o of primary grains of titanium carbide dispersed through a steel matrix making up essentially the balance, the matrix containing by weight about 10% Cr, 3% Mo, 0.85% C and the balance iron. While this composition has shown very promising results, further demands by development engineers have placed particularly heavy emphasis on materials exhibiting higher resistance to thermal shock, lower sliding friction within the trochoidal chamber and hence greater resistance to wear, and such improved physical properties as higher resistance to impact and higher transverse rupture strength.

Tooling and component part manufacturers have also been constantly seeking newer and better materials capable of withstanding stresses, thermal shock, impact, heat and wear encountered in certain hot work and impact-involving applications, such as warm heading dies, swedging dies, forging dies, die casting tools, and the like. These demands have likewise created an urgent need for steel-bonded titanium carbide material having a unique combination of physical and mechaical properties at room and elevated temperatures, particularly improved resistance to impact and improved transverse rupture strength in combination with improved resistance to thermal shock.

We have now found that we can meet the foregoing objectives by adding a small but effective amount of an alloying ingredient to the steel matrix of steel-bonded carbides wherein the desired combination of properties is markedly improved. The invention is applicable not only to the improvement of the aforementioned composition but also to a relatively broad range of steel matrices used in providing sintered steel-bonded titanium carbide compositions.

OBJECTS OF THE INVENTION

It is thus the object of the invention to provide a sintered steel-bonded titanium carbide composition characterized by an improved combination of physical and chemical properties.

Another object is to provide as an article of manufacture a wear resistant element formed of a sintered hardened steel-bonded titanium carbide composition characterized by improved physical properties, including resistance to wear.

A still further object of the invention is to provide a method of enhancing the properties of sintered steel-bonded titanium carbide compositions.

Figure 2:
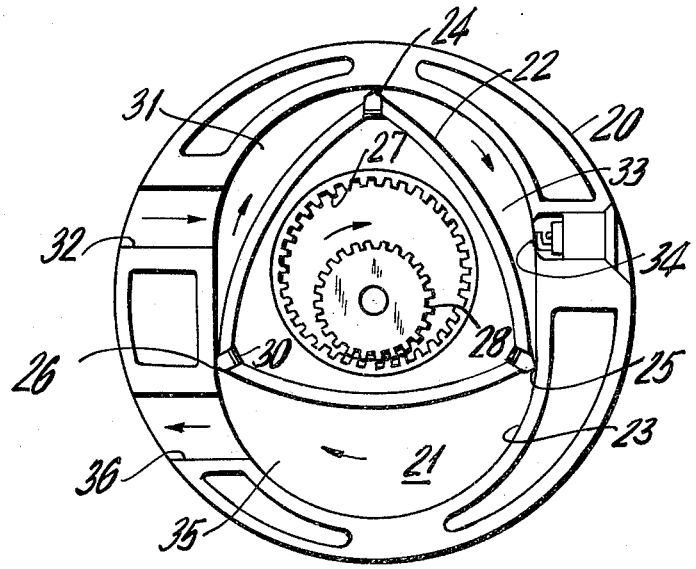

These and other objects will more clearly appear from the following disclosure and the accompanying drawing, wherein:

FIG. 1 is a schematic diagram of a friction and wear testing system employed in determining the coefficient of friction of steel-bonded titanium carbide compositions relative to a moving surface coated with a wear resistant layer; and FIG. 2 shows schematically a rotary combustion engine utilizing a heat treatable steel-bonded titanium carbide as an apex seal material.

STATEMENT OF THE INVENTION

Stating it broadly, one aspect of the invention resides in a sintered steel-bonded titanium carbide composition characterized by an improved combination of physical and anti-friction properties comprising about 15 to 60% by weight of primary grains of titanium carbide dispersed through a steel matrix makine up essentially the balance, said steel matrix being characterized metallographically by an austenitic decomposition product (e.g. pearlite, bainite and martensite), said matrix containing a small but effective amount of misch metal ranging from about 0.1 to 1.25% by weight of said matrix sufficient to effect a substantial improvement in said properties.

It is known to use small amounts of cerium (0 to 0.1%) to spheroidize free graphite in sintered steel-bonded titanium carbide compositions (note U.S. Pat. No. 3,720,504). We have found that we can achieve unexpected results in substantially non-graphitic compositions using amounts of misch metal in the foregoing range of 0.1 to 1.25 percent.

Our concept is applicable to a broad range of steel-bonded titanium carbide compositions. By way of example, titanium carbide tool steel compositions are disclosed in U.S. Pat. No. 2,828,202 (assigned to the same assignee) comprising broadly primary grains of essentially titanium carbide distributed through a heat treatable steel matrix. A preferred steel matrix is one containing by weight about 1 to 6% Cr, up to about 6%

Mo, about 0.3 to 0.8% C and and the balance essentially iron. A typical steel-bonded titanium carbide composition is one containing by weight 33% TiC in the form of primary carbide grains dispersed through a substantially non-graphitic steel matrix, the steel matrix containing by weight 3% Cr, 3% Mo, 0.6% C and the balance essentially iron. The steel is preferably produced using powder metallurgy methods which comprise broadly mixing powdered titanium carbide (primary carbide grains) with powdered steel-forming ingredients of, for example, the aforementioned composition, forming a compact by pressing the mixture in a mold (e.g. 15 t.s.i. pressure) and then subjecting the compact to liquid phase sintering under non-oxidizing condtions, such as in a vacuum. The term "primary carbide" employed herein is meant to cover the titanium carbide grains per se added directly in making up the composition and which grains are substantially unaffected by heat treatment.

In producing a titanium carbide tool steel composition in accordance with the foregoing patent containing, for example, 33% by weight of TiC (approximately 45 volume percent) and substantially the balance a steel matrix, 500 grams of TiC (of about 5 to 7 microns in size) are mixed with 1000 grams of steel-forming ingredients in a mill half filled with stainless steel balls. To the powder ingredients is added one gram of paraffin wax for each 100 grams of mix. The milling is conducted for about 40 hours, using hexane as a vehicle.

After completion of the milling, the mix is removed and dried and compacts of a desired shape pressed at about 15 t.s.i. and the compacts then subjected to liquid phase sintering in vacuum at a temperature of about 2640°F (1450°C) for about one-half hour at a vacuum corresponding to 20 microns of mercury or better. After completion of the sintering, the compacts are cooled and then annealed by heating to about 1650°F (900°C) for 2 hours followed by cooling at a rate of about 27°F (15°C) per hour to about 212°F (100°C) and thereafter furnace cooled to room temperature to produce an annealed microstructure comprising pearlite in the form of spheroidite. The annealed hardness is in the neighborhood of about 45 $R_C$ and the high carbon tool steel is capable of being machined and/or ground into any desired tool shape or machine part prior to hardening.

The hardening treatment comprises heating the machined piece to an austenitizing temperature of about 1750°F for about one-quarter hour followed by quenching in oil or water to produce a hardness in the neighborhood of about 70 $R_C$.

While the foregoing typical composition has achieved some measure of commercial success, it has certain disadvantages. For example, when used as die material, under conditions in which heat is generated due to friction, or where the metal being worked upon has been preheated, over tempering tended to occur, leading to softening of the die steel. In addition, unless care was taken to avoid rapid heating and cooling, a part made of the composition would be subject to thermal cracking. Moreover, the transverse rupture strength, while adequate for most uses, was not as high as desired, the transverse rupture strength usually ranging from about 225,000 psi to about 275,000 psi. The foregoing composition also exhibited a high coefficient of friction (sliding friction).

Another type of steel-bonded carbide is that disclosed in U.S. Pat. No. 3,653,982 (also assigned to the same assignee), a typical commercial composition being one containing by weight about 34.5% TiC as primary carbide grains dispersed through a steel matrix making up essentially the balance. The steel matrix contains by weight based on the matrix itself about 10% Cr, 3% Mo, 0.85% C and the balance essentially iron. This steel-bonded carbide differs from the aforementioned lower-chromium variety in that it is capable of being tempered at about 1000°F (538°C) and thus is capable of retaining fairly high hardness at such temperatures, particularly when used as an apex wear resistant seal strip in rotary piston engines, such as the Wankel engine. The steel matrix composition may range in composition from about 6 to 12% Cr, about 0.5 to 5% Mo, about 0.6 to 1.2% C, up to about 5% W, up to about 2% V, up to about 3% Ni, up to about 5% Co, and the balance essentially iron. However, this composition, like the previously discussed composition, is subject to thermal shock and usually exhibits a transverse rupture strength ranging from about 225,000 psi to 275,000 psi. In addition, the composition exhibits a high coefficient of sliding friction.

Another steel-bonded carbide composition is one covered by U.S. Pat. No. 3,369,891 (also assigned to the same assignee). A typical composition is one containing by weight 33.2% titanium carbide with the balance of steel matrix containing 18% Ni, 8.5% Co, 4.75% Mo, 1% Ti and the balance essentially iron. The matrix is hardened by first subjecting the steel to a solution treatment by air cooling from a temperature of about 1400°F to 1950°F (760°C to 1100°C) to produce a microstructure in the matrix characterized by the presence of soft martensite. Thereafter, the matrix surrounding the carbide grains is age hardened by heating it to about 500 °F to 1200°F (260°C to 650°C) for about 3 hours. A typical age hardening temperature is 900°F (483°C).

Thus, summarizing the foregoing, the matrix may be selected broadly from the group consisting of:

A. a matrix containing by weight about 1% to 6% Cr, about up to 6% Mo, up to about 2% vanadium, up to about 3% cobalt, up to 2% nickel, about 0.3 to 0.8% C and the balance essentially iron, B. a matrix containing by weight about 6 to 12% Cr, about 0.5 to 5% Mo, about 0.6 to 1.2% C, up to about 5% W, up to about 2% V, up to about 3% Ni, up to about 5% Co and the balance essentially iron; and C. a matrix comprising a high nickel alloy containing by weight about 10 to 30% Ni, about 0.2 to 9% Ti, up to about 5% Al, the sum of Ti and Al content not exceeding about 9 percent, less than about 0.15% C, up to about 25% Co, up to about 10% Mo, substantially the balance of the matrix being at least about 50% iron, the metals making up the matrix composition being proportioned such that when the nickel content ranges from about 10 to 22% and the sum of Al and Ti is less than about 1.5%, the molybdenum and cobalt contents are each at least about 2, and such that when the nickel content ranges from about 18 to 30% and the molybdenum content is less than 2, the sum of Al and Ti exceeds 1.5 percent.

We have found that by adding a small but effective amount of misch metal to the steel matrices of the foregoing steel-bonded titanium carbide composition, the properties are markedly improved.

Misch metal is an alloy derived from a mixture of cerium earth, e.g. cerium and lanthanum. In producing the foregoing addition alloy, the cerium earths are converted into chlorides by treatment with hydrochloric acid. These chlorides are then intimately mixed with fused calcium chloride and packed into a graphite crucible. The mixture is subjected to electrolysis by passing a heavy current through the fused salt bath to produce the alloy misch metal which comprises approximately 50% Ce, 45% La and the balance other rare earth metals. The other rare earth metals are deemed equivalents of cerium and/or lanthanum.

As stated hereinbefore, the small but effective amount of misch metal in the steel matrix may range from about 0.1 up to 1.25%. A particularly preferred composition range is about 0.125 to 1 percent and, more preferably, about 0.2 to 0.8 percent.

As illustrative of the importance of misch metal as an additive to the steel matrix, the following examples are given.

EXAMPLE 1

A series of tests was conducted on a steel-bonded composition containing 34.5% TiC by weight, the balance being essentially a steel matrix. The matrix contained 10% Cr, 2.9% Mo, 0.85% C and the balance iron. This composition was produced without misch metal and a series with the following amounts of misch metal, respectively; 0.1; 0.2; 0.3; 0.4 and 0.5 percent In producing the steel-bonded titanium carbide composition, about 690 grams of TiC of about 5 to 7 microns are mixed with 1310 grams of steel-forming ingredients of the aforementioned matrix composition in a mill half filled with stainless steel balls. To the powder ingredients is added one gram of paraffin wax for 100 grams of mix. The milling is conducted for about 40 hours, using hexane as a vehicle. The foregoing mixture was also repeated for the various additions of misch metal.

After completion of the milling, the mix is removed and dried and compacted into test coupons at 15 t.s.i. and the compacts then subjected to liquid phase sintering at a temperature of about 2670°F (1465°C) for about one-half hour at a vacuum corresponding to 20 microns of mercury or better. The compacts were heat treated following sintering by quenching in oil from 2000°F and then double tempered, one hour at 975°F (525°C) and one hour at 950°F (510°C). The test pieces were examined for porosity and the transverse rupture strength obtained. The following results were obtained:

Table I

| | Composition | Density gr/cc | ROCKWELL C Hardness Quenched 2000°F | ROCKWELL C Hardness Double Tempered 975°F/950°F 1 hr. + 1 hr. | T.R.S.* $\times 10^3$ P.S.I.** |
|---|---|---|---|---|---|
| (1) | 34.5% TiC<br>65.5% Matrix<br>Matrix<br>10.0 % Cr<br>2.9 % Mo<br>0.85% C<br>bal Fe | 6.48 | 69.3 | 68.0 | 225 |
| (2) | Same as (1) with 0.1 % misch metal | 6.52 | 69.3 | 68.2 | 300 |
| (3) | (1) + 0.2 % misch metal | 6.50 | 69.1 | 69.1 | 260 |
| (4) | (1) + 0.3 % misch metal | 6.52 | 68.5 | 67.2 | 270 |
| (5) | (1) + 0.4 % misch metal | 6.49 | 69.2 | 68.1 | 240 |
| (6) | (1) + 0.5 % misch metal | 6.49 | 69.2 | 68.1 | 240 |

*Transverse Rupture Strength
**Pounds per Inch²

Composition 1 exhibited porosity, whereas compositions 2 to 6 showed noticeably less porosity. The decrease in porosity was accompanied by a marked improvement in transverse rupture strength. At least about 0.1 percent misch metal resulted in a strength increase of over 30 percent. The steel matrix should preferably contain at least about 0.125 percent misch metal. All of the foregoing compositions in the hardened state showed martensite in the steel matrix.

The transverse rupture strength was determined on a rectangular specimen measuring 0.200 ± 0.01 inch thick by 0.250 ±0.01 inch wide by 0.750 inch minimum length. The specimen is supported as a beam on two rods of sintered ground tungsten carbide of 0.125 ±0.001 inch diameter, the two rods being spaced 9/16 inch apart. A load is then applied centrally on the supported specimen sufficient to cause rupture and the transverse rupture strength calculated using the beam formula.

Tests were also conducted on a composition containing 50% by weight of TiC and the balance a steel matrix with and without misch metal. The composition and results are given in Table 2 below.

Table 2

| | Composition | Density gr/cc 1775°F | ROCKWELL C Hardness Quenched 1775°F | ROCKWELL C Hardness Tempered 600°F | T.R.S. $\times 10^3$ P.S.I. |
|---|---|---|---|---|---|
| (7) | 50%/o TiC<br>Bal. Matrix<br>5.5 % Cr<br>1.2 % Mo<br>0.3 % Si | | | | |

Table 2-continued

| | Composition | Density gr/cc 1775°F | ROCKWELL C Hardness Quenched 1775°F | Tempered 600°F | T.R.S. ×10³ P.S.I. |
|---|---|---|---|---|---|
| | 0.15 % V<br>1.0 % C<br>bal. Fe | 6.08 | 75.2 | 72.3 | 175 |
| (8) | (7) + 0.3% misch metal | 6.12 | 75.0 | 72.0 | 200 |

As will be noted, the composition tends to have a higher intrinsic hardness due to the large amount of titanium carbide present. Because of the large amount of titanium carbide, the composition 7 without misch metal exhibits a transverse rupture strength of 175,000 psi. On the other hand, when 0.3 percent of misch metal is added, the transverse rupture strength is increased by over 14% to 200,000 psi.

Composition 7 without misch metal showed porosity as evidenced by the presence of pinholes, whereas composition 8 with 0.3 percent misch metal showed no pinholes.

Examples of other compositions are given in Tables 3 and 4 which follows.

Table 3

| | Composition | Density gr/cc | ROCKWELL C Hardness Quenched 2000°F | Double Tempered 975°F/950°F | T.R.S. ×10³ P.S.I. |
|---|---|---|---|---|---|
| (9) | 20$^{w}$/o TiC<br>Bal. Matrix<br>4.0 %Cr<br>3.5 %Mo<br>2.0 %Co<br>1.0 %Ni<br>0.4 % C<br>bal. Fe | 7.01 | 64.6 | 58.0 | 325 |
| (10) | (9) + 0.75% misch metal | 7.01 | 69.6 | 61.0 | 360 |

Table 4

| | Composition | Density gr/cc | ROCKWELL C Hardness Solution Quenched 2000°F | Aged At 900°F For 3 hrs. | T.R.S. ×10³ P.S.I. |
|---|---|---|---|---|---|
| (11) | 32.2$^{w}$/o TiC<br>Bal. Matrix<br>18.0 % Ni<br>8.5 % Co<br>4.75 % Mo<br>1.0 % Ti<br>bal. Fe | 6.64 | 49.2 | 63.8 | 320 |
| (12) | (11) + 0.3% misch metal | 6.63 | 49.0 | 62.5 | 350 |

As will be noted for each of the compositions in Tables 3 and 4, the transverse rupture strength is increased. Composition 9 [Table 3 ] showed noticeable porosity, whereas composition 10 with 0.75 percent misch metal showed much less porosity.

Composition 11 which employs a high nickel steel as a matrix is solution quenched to provide soft martensite of 49.2 $R_C$ which is age-hardened to 63.8 $R_C$ at 900°F. This composition without misch metal showed porosity as evidenced by the presence of pinholes, whereas, following the addition of 0.3 percent misch metal, the porosity was noticeably reduced. Generally, the reduction of porosity is accompanied by a substantial increase in transverse rupture strength.

It might be added that a substantial improvement was also noted in the impact strength as follows:

Table 5

| | Composition | Impact Strength in.-lb/in.² |
|---|---|---|
| | (9) | 441 |
| (9) | + 0.75% misch metal | 477 |
| | (7) | 249 |
| (7) | + 0.3% misch metal | 339 |

Particular attention is directed to composition 7 which contains 50$^{w}$/o of titanium carbide. The impact strength thereof was increased from 249 to 339 inc.-lb/in² or an increase of 36 percent.

The impact strength was determined on a specimen measuring 0.200 inch thick by 0.200 inch wide by 0.750 inch long. The specimen is fixed at one end to provide a cantilever, about 0.30 inch of the length being gripped at the fixed end, the portion extending from the fixed end being 0.45 inch long. A specified weight is dropped upon the free end of the cantilevered specimen at different heights until failure occurs. The impact strength was then measured by multiplying the height in inches by the weight in pounds and the product of the multiplication divided by the cross-sectional area of the specimen (0.04 square inch), the impact strength being given as inch-lbs/in².

As stated hereinbefore, the complex sealing system of the rotary combustion engine has placed stringent demands on engineering materials used in component parts thereof. One of the most important components of the sealing system is the apex seal.

Present developments in the rotary combustion engine contemplate the use of an aluminum housing. The rotating piston which has a generally triangular shape is in contact with the end walls of the housing by means of the apices thereof which require the use of a seal material as a seal-off between the spaces defined between the apices. The seal must have wear resistance as well as lubricity. However, the aluminum in the housing is generally soft compared to most materials of construction and has poor wear resistance and requires a coating, such as chromium or Elnisil (previously described).

FIG. 2 shows schematically a rotary combustion engine comprising an aluminum housing 20 having a chamber 21 in which is mounted a triangularly shaped rotary piston 22 in sealing contact with the end wall 23 of the chamber at its apices 24 to 26. The rotary piston has an internal gear mounted thereon which is driven by gear 28 mounted on a shaft running perpendicular to the rotary piston. The coating material is applied to end wall 23 as shown by the heavy line to provide sufficient wear resistance to the material of the apices in rubbing contact with the end wall. The material of the apices comprises spring mounted inserts 24, 25, 26 of steel-bonded titanium carbide tool steel maintained in continual sealing contact with the end wall via spring 30.

In operation, as the piston rotates, fuel and air are received at intake zone 31 through intake 32. The fuel-air mixture is then compressed and fired in compression zone 33 via spark plug 34 and the combusted gases at exhaust zone 35 exhausted through outlet 36.

Since the apex seals during operation rub against the very abrasive trochoid surface at varying angles at relatively high stresses, it is important that the seal material fulfill the following requirements:

1. Low coefficient of friction
2. Relatively low specific gravity to minimize chatter on the trochoid housing
3. Inherent lubricity to permit the seals to operate at high temperatures
4. Good strength and resistance to impact
5. Good wear resistance
6. And be compatible with the coating material on the trochoid facing.

The product of the invention fulfills these requirements by providing a unique combination of properties, including low coefficient of friction, relatively low specific gravity, inherent lubricity at elevated temperatures, good strength, improved resistance to wear, corrosion, oxidation, heat and improved resistance to impact. Moreover, the product of the invention is compatible as a seal with such hard facing materials as "hard chromium plating" and "Elnisil."

We have found that the addition of misch metal to steel-bonded titanium carbide compositions provides markedly improved lubricity as evidenced by low coefficient of friction determined against the foregoing hard facing materials.

The coefficient of friction is determined by using a system shown schematically in FIG. 1. A metal ring 10 is provided mounted on a rotatable arbor 10A, the outside surface of the ring being coated with the hard facing material, e.g. hard chromium, the coating material known by the trademark Elnisil, and the like. A block 11 of the steel-bonded titanium carbide composition is freely supported on the top of the ring as shown with a predetermined load 12, e.g. 6.6 lbs. applied to the block. The arbor is caused to rotate at 180 rpm and the force of friction 13 then applied via a suitable element to friction load pick-up means 14 which translates the force to a reading on friction load indicator or gage 15. The gage reading is divided by the load 12 on the block to provide the coefficient of friction. In addition, the amount of volumetric wear was measured.

A running time of about 40 minutes was taken as the standard running period. Those blocks which tended to behave poorly generally had a running time of only a few minutes. The coefficient of friction was determined and, following completion of the test, the amount of wear was measured in terms of volume of material worn away.

Illustrative results are given in the following table:

Table 6

| Block Material | Coefficient of Friction | Volume Loss ($\times 10^{-5}$cm$^3$) Block | Ring | Test Period Minutes | Compatibility |
|---|---|---|---|---|---|
| (1A) 34.5% TiC 63.5% Matrix (10% Cr, 2.9% Mo, 0.85% C, bal. Fe) | 0.756 | 20.0 | 64.0 | 40 | Good |
| (2A) (1A) + 0.3% misch metal | 0.378 | 6.2 | 37.1 | 40 | Very Good |
| (9) 20% TiC 80% matrix (4% Cr, 3.5% Mo, 3% Co, 1% Ni, 0.4% C and bal. Fe) | 0.908 | −6.8* | 58.8 | 3 | Very Poor |
| (10) (9) + 0.75% misch metal | 0.303 | 3.0 | 20.0 | 40 | Excellent |
| (7) 50% TiC 50% Matrix (5.5% Cr, 1.2% Mo, 0.3% Si; 0.15% V, 1.0% C and bal. Fe) | 0.606 | 5.0 | 26.7 | 40 | Fair |
| (8) | | | | | |

Table 6-continued

| Block Material | Coefficient of Friction | Volume Loss ($\times 10^{-5} cm^3$) Block | Ring | Test Period Minutes | Compatibility |
|---|---|---|---|---|---|
| (7) + 0.3% misch metal | 0.106 | 3.2 | 16.5 | 40 | Excellent |

*Negative value indicates metal pick-up due to galling.

Comparing composition 1A [without misch metal] to composition 2A [with 0.3 percent misch metal], it will be noted that the coefficient of friction of 2A dropped to about one-half of 1A. In addition, there was a marked drop in the amount of wear with regard to composition 2A after 40 minutes of test. The foregoing compositions contained martensite in the matrix.

With regard to compositions 9 and 10, it will be noted that the coefficient of friction of composition 10 fell about 67 percent compared to 9. The test on 9 ran only 3 minutes and showed poor compatibility with the ring coating. On the other hand, composition 10 gave excellent results after 40 minutes. In this composition, the steel matrix in the hardened condition contained martensite.

Referring now to compositions 7 and 8, the composition with 0.3 percent misch metal [composition 8], showed a very large drop in friction, that is, from 0.606 to 0.106 and also excellent wear characteristics. The steel matrix here contained martensite.

The addition of misch metal to the high nickel steel matrix (e.g. composition 12 of Table 4) resulted in a marked decrease in coefficient of friction with the Elnisil coating, that is, from 0.908 to 0.454. The addition of misch metal to the matrix showed a marked decrease in wear.

Friction tests conducted against a hard facing of chromium plate also showed a marked decrease in friction when misch metal was added to the steel matrix. For example, in a composition containing 40% TiC and the balance a matrix comprising by weight 5.5% Cr, 1.2% Mo, 0.3% Si, 0.3% V, 1% C, with 0.3 percent misch metal, and the balance iron, the coefficient of friction was 0.151. At 50% TiC with the same matrix, the coefficient of friction was 0.303. Both steel-bonded carbides showed no galling after 40 hours. The compositions without misch metal exhibited a higher coefficient of friction.

Resistance to thermal cracking was determined for a composition containing by weight 20% TiC and the balance a steel matrix containing 4.0% Cr, 3.5% Mo, 2.0% Co, 1.0% Ni, 0.4% C, 0.75 percent misch metal and the balance essentially iron. This composition exhibited an oil quench hardness from 2000°F of 68 $R_C$ and a tempered hardness after air cooling from 975°F (1 hour heating) of 61 $R_C$. The transverse rupture strength of the tempered composition was 340,000 psi.

The test pieces comprised ground pieces of 1 ×1 ×¼ which were heated to 1500°F followed by quenching in oil maintained at room temperature. The heating and quenching cycle was repeated for more than 25 times without any thermal cracking occurring. The same composition without the misch metal exhibited cracking before 25 cycles.

Summarizing the foregoing, the invention provides a sintered steel-bonded titanium carbide composition comprising primary carbides of about 15 to 60% by weight of TiC dispersed through a heat treatable steel matrix making up essentially the balance, the steel matrix containing a small but effective amount of misch metal ranging from about 0.1 to 1.25% by weight, at least about 0.125 percent of misch metal being preferred. Preferably, the misch metal may range from about 0.125 to 1 percent and, more preferably, from about 0.2 to 0.8 percent.

The invention is particularly applicable to steel-bonded titanium carbide compositions of the following types, to wit: (1) about 15 to 25% by weight of titanium carbide and the balance a heat treatable steel matrix containing misch metal and (2) about 30 to 60% by weight of titanium carbide and the balance essentially a heat treatable steel matrix.

As stated hereinbefore, the steel matrix is preferably selected from the group consisting of:

A. a matrix containing by weight about 1 to 6% Cr, about up to about 6% Mo, up to about 2% vanadium, up to about 3% cobalt, up to 2% nickel, about 0.3 to 0.8% C and the balance essentially iron;

B. a matrix containing by weight about 6 to 12% Cr, about 0.5% to 5% Mo, about 0.6 to 1.2% C, up to about 5% W, up to about 2% V, up to about 3% Ni, up to about 5% Co, and the balance essentially iron; and C. a matrix comprising a high nickel alloy containing by weight about 10 to 30% Ni, about 0.2 to 9% Ti, up to about 5% Al, the sum of Ti and Al content not exceeding about 9%, less than about 0.15% C, up to about 25% Co, up to about 10% Mo, substantially the balance of the matrix being at least about 50% iron, the metals making up the matrix composition being proportioned such that when the nickel content ranges from about 10 to 22 percent and the sum of Al and Ti is less than about 1.5 percent, the molybdenum and cobalt contents are each at least about 2 percent and such that when the nickel content ranges from about 18 to 30 percent and the molybdenum content is less than 2 percent, the sum of Al and Ti exceeds 1.5 percent.

The foregoing matrix steels are characterized in the heat treated state by the presence of martensite. Thus, as regards matrix steel A, the refractory carbide tool steel produced therefrom is heat treated by heating it to above the austenitizing temperature, e.g. to 1750°F, and then quenching it to form hard martensite. Following the quench, the steel may be tempered by heating over the temperature range of about 250°F to 550°F for up to about 5 hours.

In the case of steel-bonded titanium carbide compositions using steel B as the matrix, the matrix is similarly heat treated by quenching from above the austenitizing temperature in the range of about 1700°F to 2050°F, e.g. from 1750°F. However, the tempering is conducted at a higher temperature, e.g. from about 900°F to 1050°F, such as 1000°F, for about 1 or 2 hours, wherein secondary hardening effects are obtained due to the formation of secondary carbides.

In the case of steel matrix C, steel-bonded titanium carbide compositions produced therefrom are hardened by subjecting the composition to a solution heat treatment by cooling them (e.g. air cooling) from a solution temperature of about 1400°F to 1950°F (760°C to 1100°C) to produce a microstructure in the matrix characterized by the presence of soft martensite. Thereafter, the matrix surrounding the carbide grains is age-hardened by heating the refractory carbide steel at a temperature of about 500°F to 1200°F (260°C to 650°C) for about three hours. A typical age-hardening temperature is 900°F (483°C).

It should be stated that the steel-bonded titanium carbide composition of the invention is additionally advantageous in that it can be used in the production of hard coatings on metal substrates, such as produced by plasma spraying. In this connection, pieces of the sintered material are ground in a ball mill to produce a powder for use in powder spraying, and the like.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A sintered steel-bonded titanium carbide composition characterized by an improved combination of physical and anti-friction properties which comprises, about 15 to 60% by weight of primary grains of titanium carbide dispersed through a steel matrix making up essentially the balance, said steel matrix being characterized metallographically by an austenitic decomposition product and containing a small but effective amount of misch metal ranging from about 0.1% to 1.25% by weight of said matrix, said sintered titanium carbide composition in the hardened condition being characterized by substantial improvement in transverse rupture strength and improved resistance to wear and to galling as evidenced by a substantial decrease in the coefficient of friction.

2. The steel-bonded titanium carbide composition of claim 1, wherein the amount of titanium carbide ranges from about 15 to 25% by weight of the total composition.

3. The titanium carbide composition of claim 1, wherein the amount of titanium carbide ranges from about 30 to 60% by weight of the total composition.

4. The steel-bonded titanium carbide composition of claim 2, wherein the amount of misch metal in said matrix ranges from about 0.125 to 1% by weight of said matrix.

5. The steel-bonded titanium carbide composition of claim 3, wherein the amount of misch metal in said matrix ranges from about 0.125 to 1% by weight of said matrix.

6. A sintered steel-bonded titanium carbide composition characterized by an improved combination of physical and anti-friction properties which comprises, about 15 to 60% by weight of primary grains of titanium carbide dispersed through a steel matrix making up essentially the balance, said steel matrix being characterized metallographically by an austenitic decomposition product and containing a small but effective amount of misch metal ranging from about 0.1 to 1.25% by weight of said matrix sufficient to effect an improvement in said properties, said steel matrix being selected from the group consisting of:

A. a matrix containing by weight about 1 to 6% Cr, up to about 6% Mo, up to about 2% vanadium, up to about 3% cobalt, up to 2% nickel, about 0.3 to 0.8% C and the balance essentially iron, B. a matrix containing by weight about 6 to 12% Cr, about 0.5 to 5% Mo, about 0.6 to 1.2% C, up to about 5% W, up to about 2% V, up to about 3% Ni, up to about 5% Co and the balance essentially iron; and C. a matrix comprising a high nickel alloy containing by weight about 10 to 30% Ni, about 0.2 to 9% Ti, up to about 5% Al, the sum of Ti and Al content not exceeding about 9 percent, less than about 0.15% C, up to about 25% Co, up to about 10% Mo, substantially the balance of the matrix being at least about 50% iron, the metals making up the matrix composition being proportioned such that when the nickel content ranges from about 10 to 22 percent and the sum of Al and Ti is less than about 1.5 percent, the molybdenum and cobalt contents are each at least about 2 percent, and such that when the nickel content ranges from about 18 to 30 percent and the molybdenum content is less than 2 percent, the sum of Al and Ti exceeds 1.5 percent, said sintered titanium carbide composition in the hardened condition being characterized by substantial improvement in transverse rupture strength and improved resistance to wear and galling as evidenced by a substantial decrease in the coefficient of friction.

7. The steel-bonded titanium carbide composition of claim 6, wherein the amount of titanium carbide ranges from 15 percent to 25% by weight of the total composition.

8. The steel-bonded titanium carbide composition of claim 6, wherein the amount of titanium carbide ranges from about 30 to 60% by weight of the total composition.

9. The steel-bonded titanium carbide composition of claim 7, wherein the amount of misch metal in said matrix ranges from about 0.125 to 1% by weight of said matrix.

10. The steel-bonded titanium carbide composition of claim 8, wherein the amount of misch metal in said matrix ranges from 0.125 to 1% by weight of said matrix.

11. A hardened, wear resistant, sintered steel-bonded titanium carbide composition characterized by an improved combination of physical and anti-friction properties which comprises, about 15 to 60% by weight of primary grains of titanium carbide dispersed through a hardened steel matrix characterized by the presence of martensite, said steel matrix containing a small but effective amount of misch metal ranging from about 0.1 to 1.25% by weight of said matrix sufficient to effect a substantial improvement in said properties, said sintered titanium carbide composition in the hardened condition being characterized by substantial improvement in transverse rupture strength and improved resistance to wear and galling as evidenced by a substantial decrease in the coefficient of friction.

12. The hardened, wear resistant steel-bonded composition of claim 11, wherein the amount of titanium carbide ranges from about 15 to 25% by weight of the total composition.

13. The hardened, wear resistant steel-bonded titanium carbide composition of claim 11, wherein the amount of titanium carbide ranges from about 30 to 60% by weight of the total composition.

14. A hardened, wear resistant, sintered steel-bonded titanium carbide composition characterized by an improved combination of physical and anti-friction properties which comprises, about 15 to 60% by weight of primary grains of titanium carbide dispersed through a hardened steel matrix making up essentially the balance, said steel matrix being characterized by the pressure of martensite, said steel matrix containing a small but effective amount of misch metal ranging from about 0.1 to 1.25% by weight of said matrix sufficient to effect a substantial improvement in said properties, said steel matrix being selected from the group consisting of:

A. a matrix containing by weight about 1 to 6% Cr, up to about 6% Mo, up to about 2% vanadium, up to about 3% cobalt, up to 2% nickel, about 0.3 to 0.8% C and the balance essentially iron;

B. a matrix containing by weight about 6 to 12% Cr, about 0.5 to 5% Mo, about 0.6 to 1.2% C, up to about 5% W, up to about 2% V, up to about 3% Ni, up to about 5% Co and the balance essentially iron; and C. a matrix comprising a high nickel alloy containing by weight about 10 to 30% Ni, about 0.2 to 9% Ti, up to about 5% Al, the sum of Ti and Al content not exceeding about 9 percent, less than about 0.15% C, up to about 25% Co, up to about 10% Mo, substantially the balance of the matrix being at least about 50% iron, the metals making up the matrix composition being proportioned such that when the nickel content ranges from about 10 to 22 percent and the sum of Al and Ti is less than about 1.5 percent, the molybdenum and cobalt contents are each at least about 2 percent, and such that when the nickel content ranges from about 18 to 30 percent and the molybdenum content is less than 2 percent, the sum of Al and Ti exceeds 1.5 percent.

said sintered titanium carbide composition in the hardened condition being characterized by substantial improvement in transverse rupture strength and improved resistance to wear and galling as evidenced by a substantial decrease in the coefficient of friction.

15. The hardened, wear resistant, steel-bonded titanium carbide composition of claim 14, wherein the amount of titanium carbide ranges from about 15 to 25% by weight of the total composition.

16. The hardened, wear resistant, steel-bonded titanium carbide composition of claim 14, wherein the amount of titanium carbide ranges from about 30 to 60% by weight of the total composition.

17. The hardened, wear resistant, steel-bonded titanium carbide composition of claim 15, wherein the amount of misch metal in said matrix ranges from about 0.125 to 1% by weight of said matrix.

18. The hardened, wear-resistant, steel-bonded titanium carbide composition of claim 16, wherein the amount of misch metal in said matrix ranges from about 0.125 to 1% by weight of said matrix.

19. As an article of manufacture, a wear resistant element formed from a hardened, sintered steel-bonded titanium carbide composition characterized by an improved combination of physical and anti-friction properties which comprises, about 15 to 60% by weight of primary grains of titanium carbide dispersed through a hardened steel matrix characterized by the presence of martensite, said steel matrix containing a small but effective amount of misch metal ranging from about 0.1 to 1.25% by weight of said matrix sufficient to effect a substantial improvement in said properties, said sintered titanium carbide composition in the hardened condition being characterized by substantial improvement in transverse rupture strength and improved resistance to wear and galling as evidenced by a substantial decrease in the coefficient of friction.

20. The article of claim 19, wherein the wear resistant element is an apex seal.

21. The article of manufacture of claim 19, wherein the amount of titanium carbide ranges from about 15 to 25% by weight of the total composition.

22. The article of manufacture of claim 19, wherein the amount of titanium carbide ranges from about 30 to 60% by weight of the total composition.

23. The article of claim 22, wherein the wear resistant element is an apex seal.

24. The article of manufacture of claim 21, wherein the amount of misch metal in said matrix ranges from about 0.125% to 1% by weight of said matrix.

25. The article of manufacture of claim 22, wherein the amount of misch metal in said matrix ranges from about 0.125 to 1% by weight of said matrix.

26. The article of claim 25, wherein the wear resistant element is an apex seal.

27. As an article of manufacture, a wear resistant element formed from hardened, sintered steel-bonded titanium carbide composition characterized by an improved combination of physical and anti-friction properties which comprises about 15 to 60% by weight of primary grains of titanium carbide dispersed through a hardened steel matrix characterized by the presence of martensite, said steel matrix containing a small but effective amount of misch metal ranging from about 0.1 to 1.25% by weight of said matrix sufficient to effect a substantial improvement in said properties, said steel matrix being selected from the group consisting of:

A. a matrix containing by weight about 1 to 6% Cr, up to about 6% Mo, up to about 2% vanadium, up to about 3% cobalt, up to 2% nickel, about 0.3 to 0.8% C and the balance essentially iron;

B. a matrix containing by weight about 6% to 12% Cr, about 0.5 to 5% Mo, about 0.6 to 1.2% C, up to about 5% W, up to about 2% V, up to about 3% Ni, up to about 5% Co and the balance essentially iron; and C. a matrix comprising a high nickel alloy containing by weight about 10 to 30% Ni, about 0.2 to 9% Ti, up to about 5% Al, the sum of Ti and Al content not exceeding about 9 percent, less than about 0.15% C, up to about 25% Co, up to about 10% Mo, substantially the balance of the matrix being at least about 50% iron, the metals making up the matrix composition being proportioned such that when the nickel content ranges from about 10 to 22 percent and the sum of Al and Ti is less than about 1.5 percent, the molybdenum and cobalt content are each at least about 2 percent and such that when the nickel content ranges from about 18 to 30 percent and the molybdenum content is less than 2 percent, the sum of Al and Ti exceeds 1.5 percent, said sintered titanium carbide composition in the hardened condition being characterized by substantial improvement in transverse rupture strength and improved resistance to wear and galling as evidenced by a substantial decrease in the coefficient of friction.

28. The article of claim 27, wherein the wear resistant element is an apex seal.

29. The article of manufacture of claim 27, wherein the amount of titanium carbide ranges from about 15 to 25% by weight of the total composition.

30. The article of manufacture of claim 27, wherein the amount of titanium carbide ranges from about 30 to 60% by weight of the total composition.

31. The article of claim 30, wherein the wear resistant element is an apex seal.

32. The article of manufacture of claim 29, wherein the amount of misch metal in said matrix ranges from about 0.125 to 1% by weight of said matrix.

33. The article of manufacture of claim 30, wherein the amount of misch metal in said matrix ranges from about 0.125 to 1% by weight of said matrix.

34. The article of claim 33, wherein the wear resistant element is an apex seal.

35. In a method of producing a sintered, steel-bonded titanium carbide composition containing about 15 to 60% by weight of primary grains of titanium carbide dispersed through a steel matrix making up essentially the balance, wherein said grains of titanium carbide are mixed with powdered steel-forming ingredients, compacted to the desired shape and said shape then sintered at an elevated liquid phase sintering temperature of said matrix, the improvement of enhancing the physical and anti-friction properties of said composition which comprises, adding to said steel-forming ingredients a small but effective amount of misch metal ranging from about 0.1 to 1.25 percent by weight of said steel-forming ingredients prior to compacting and sintering said composition, said sintered titanium carbide composition in the hardened condition being characterized by substantial improvement in transverse rupture strength and improved resistance to wear and galling as evidenced by a substantial decrease in the coefficient of friction.

36. The method of claim 35, wherein said steel-bonded titanium carbide composition is produced to contain about 15 to 25% by weight of titanium carbide based on the total composition.

37. The method of claim 35, wherein said steel-bonded titanium carbide composition is produced to contain about 30 to 60% by weight of titanium carbide based on the total composition.

38. The method of claim 36, wherein the amount of misch metal added to the matrix composition ranges from about 0.125 to 1% by weight of said matrix.

39. The method of claim 37, wherein the amount of misch metal added to the matrix composition ranges from about 0.125 to 1% by weight of said matrix.

40. The method of claim 35, wherein the steel matrix is selected from the group consisting of:

A. a matrix containing by weight about 1 to 6% Cr, up to about 6% Mo, up to about 2% vanadium, up to about 3% cobalt, up to 2% nickel, about 0.3 to 0.8% C and the balance essentially iron;

B. a matrix containing by weight about 6 to 12% Cr, about 0.5 to 5% Mo, about 0.6 to 1.2% C, up to about 5% W, up to about 2% V, up to about 3% Ni, up to about 5% Co and the balance essentially iron; and C. a matrix comprising a high nickel alloy containing by weight about 10 to 30% Ni, about 0.2 to 9% Ti, up to about 5% Al, the sum of Ti and Al content not exceeding about 9 percent, less than about 0.15% C, up to about 25% Co, up to about 10% Mo, substantially the balance of the matrix being at least about 50% iron, the metals making up the matrix composition being proportioned such that when the nickel content ranges from about 10 to 22% and the sum of Al and Ti is less than about 1.5 percent, the molybdenum and cobalt contents are each at least about 2 percent, and such that when the nickel content ranges from about 18 to 30 percent and the molybdenum content is less than 2 percent, the sum of Al and Ti exceeds 1.5 percent.

* * * * *

UNITED STATES PATENT OFFICE

CERTIFICATE OF CORRECTION

Patent No. 3,977,837 Dated August 31, 1976

Inventor(s) M. Kumar Mal et al

It is certified that error appears in the above-identified patent and that said Letters Patent are hereby corrected as shown below:

Column 15, lines 11-12, "pressure" should read -- presence --.

Signed and Sealed this

Thirty-first Day of May 1977

[SEAL]

*Attest:*

RUTH C. MASON
*Attesting Officer*

C. MARSHALL DANN
*Commissioner of Patents and Trademarks*